United States Patent [19]

Aparicio, Jr. et al.

[11] Patent Number: 4,480,510

[45] Date of Patent: Nov. 6, 1984

[54] POWERED RATCHET WRENCH

[75] Inventors: Thomas Aparicio, Jr.; Dave D. Nagel, both of Houston, Tex.; Ron Graham, Norco, Calif.

[73] Assignee: Gratec, Inc., Norco, Calif.

[21] Appl. No.: 306,089

[22] Filed: Sep. 28, 1981

[51] Int. Cl.[3] ..... B25B 13/46

[52] U.S. Cl. ..... 81/57.39; 74/128; 74/142; 74/577 M

[58] Field of Search ..... 81/57.39; 74/577 M, 74/128, 142

[56] References Cited

U.S. PATENT DOCUMENTS

| | | | |
|---|---|---|---|
| 219,740 | 9/1879 | Kirkwood | 74/577 M |
| 1,812,816 | 6/1931 | Weaver | 81/57.39 |
| 2,708,345 | 5/1955 | Miles | 81/57.39 |
| 4,027,560 | 6/1977 | Parker | 81/57.39 |

FOREIGN PATENT DOCUMENTS

| | | | |
|---|---|---|---|
| 2086785 | 5/1982 | United Kingdom | 81/57.39 |
| 602364 | 9/1978 | U.S.S.R. | 81/57.39 |

*Primary Examiner*—James L. Jones, Jr.
*Attorney, Agent, or Firm*—Neal J. Mosely

[57] ABSTRACT

A powered ratchet wrench for turning threaded members, such as nuts or bolt heads, consists of a wrench assembly having a reaction arm adapted to be positioned over a threaded member, viz. nut or bolt, for supporting the same and operating a socket wrench through a ratchet mechanism applying a torque for tightening or loosening the nuts or bolts. The wrench assembly has a box shaped housing with an open end portion supporting a ratchet mechanism and a double-acting fluid operated cylinder having an operating piston extending therefrom for operating the ratchet mechanism. The ratchet mechanism consists of a ratchet wheel supported between two plates on bearing sleeves extending from side to side at the open end portion of the housing. A pair of pawls with driving teeth engage opposite sides of the ratchet wheel and are spring biased toward engagement with the ratchet teeth. The pawls are pivotally supported on each other and on the ratchet wheel supporting plates. The operating cylinder is supported on the housing with its piston secured to one of the pawls for driving the pawls to rotate the ratchet wheel on extension of the piston and to rotate the pawls in a ratcheting movement relative to the ratchet wheel on retraction of the piston.

3 Claims, 4 Drawing Figures

POWERED RATCHET WRENCH

BACKGROUND OF THE INVENTION

1. Field of the Invention

This invention relates to new and useful improvements in power wrenches and more particularly to an powered ratchet wrench.

2. Brief Description of the Prior Art

Power wrenches for threaded members, such as nuts and bolts are described in a variety of patents extending over a period of 20 years or more.

Huff U.S. Pat. No. 2,972,918 discloses a hydraulically operated wrench and special supporting arrangement for use in fastening and unfastening large size nuts used on head closures for heaters and exchangers.

Franck U.S. Pat. No. 3,198,040 discloses a hydraulically operated wrench used in making up fittings, such as couplings.

Wilmeth U.S. Pat. No. 3,706,244 discloses another type of hydraulic wrench used for tightening or loosening bolts or nuts on large pieces of flanged equipment.

Parker U.S. Pat. No. 4,027,560 discloses a hydraulic wrench having an adapter for varying the point of application of force to the lateral arm of the wrench.

Keller U.S. Pat. No. 3,930,776 discloses a hydraulic wrench having a novel ratchet arrangement therein, Junkers U.S. Pat. No. 4,027,561 discloses another type of hydraulically operated wrench having a ratchet arrangement for driving the wrench.

Wilmeth U.S. Pat. No. 4,091,890 and 4,200,011 disclose still another type of ratchet arrangement in a hydraulically operated wrench

SUMMARY OF THE INVENTION

One of the objects of this invention is to provide an improved fluid operated ratchet wrench which overcomes many of the objections and drawbacks of the prior art.

Another object of the invention is to provide an improved fluid operated ratchet wrench which is relatively inexpensive to manufacture and assemble.

Still another object of this invention is to provide an improved fluid operated ratchet wrench having a ratchet wheel with two driving pawls engaged on opposite sides thereof which are movable together in one direction to rotate the ratchet wheel and movable together in the opposite direction in a ratcheting movement relative to the ratchet wheel.

Other objects of this invention will become apparent from time to time throughout the specification and claims hereinafter related.

These and other objects of the invention are accomplished by a powered ratchet wrench for turning threaded members, such as nuts or bolt heads, which consists of a wrench assembly having a reaction arm adapted to be positioned over a threaded member, viz. nut or bolt, for supporting the same and operating a socket wrench through a ratchet mechanism applying a torque for tightening or loosening the nuts or bolts.

The wrench assembly has a box shaped housing with an open end portion supporting a ratchet mechanism and a double-acting fluid operated cylinder having an operating piston extending therefrom for operating the ratchet mechanism. The ratchet mechanism consists of a ratchet wheel supported between two plates on bearing sleeves extending from side to side at the open end portion of the housing.

A pair of pawls with driving teeth engage opposite sides of the ratchet wheel and are spring biased toward engagement with the ratchet teeth. The pawls are pivotally supported on each other and on the ratchet wheel supporting plates.

The operating cylinder is supported on the housing with its piston secured to one of the pawls for driving the pawls to rotate the ratchet wheel on extension of the piston and to rotate the pawls in a ratcheting movement relative to the ratchet wheel on retraction of the piston.

DESCRIPTION OF THE PREFERRED EMBODIMENTS

Figure 1:
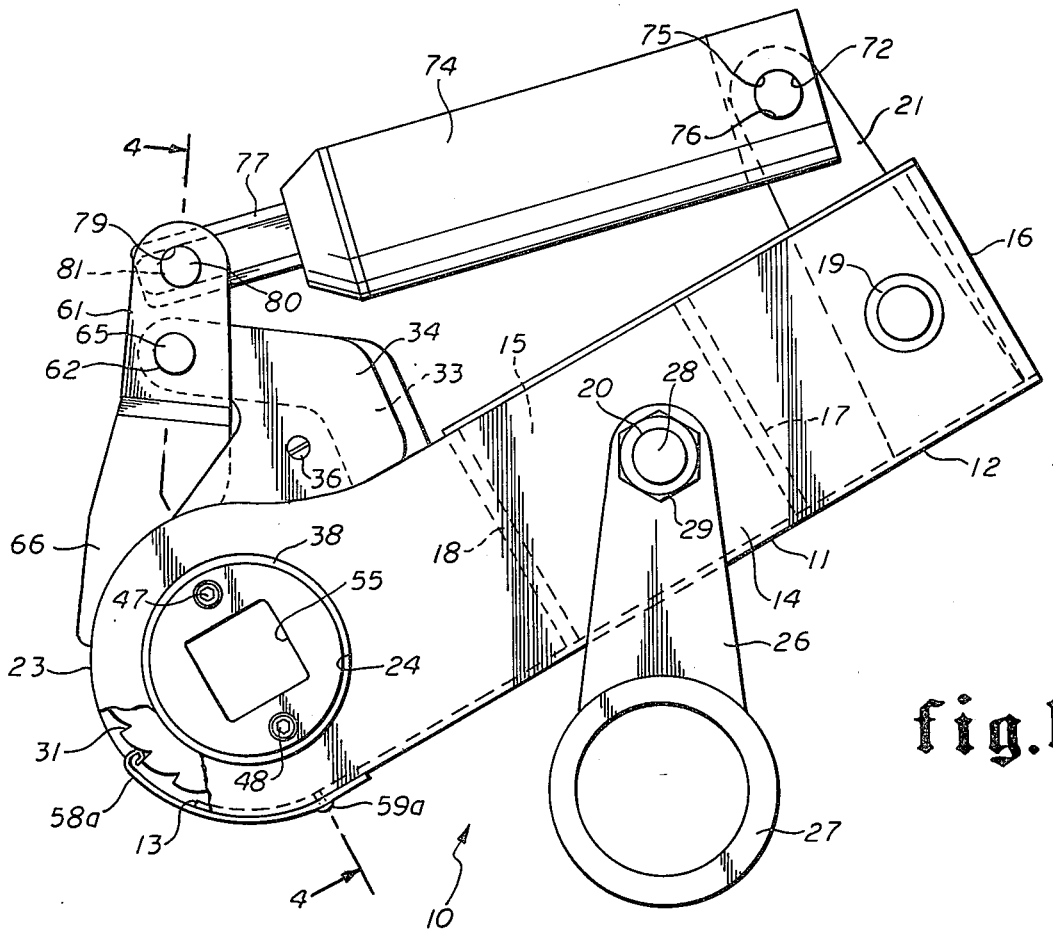
FIG. 1 is a view in elevation of a fluid powered ratchet wrench assembly, including operating cylinder and supporting reaction arm for the wrench, representing a preferred embodiment of this invention.

Referring to the drawings by numerals of reference, and more particularly to FIG. 1, there is shown a powered ratchet wrench 10 having a box shaped housing 11. Housing 11 is oblong in shape, as seen in FIG. 1, and is of rectangular cross section along planes taken normal to the plane of FIG. 1. Box shape housing 11 has a flat bottom wall 12 which curves toward one end and terminates in the edge 13 of an opening from the housing which receives the ratchet mechanism. Housing 11 has side wall 14 and a rear side wall 15 spaced therefrom. An end wall 16 closes housing 11 at one end.

Reinforcing walls 17 and 18 extend laterally across between side walls 14 and 15. Tubular reinforcing members 19 and 20 extend laterally across box shaped housing 11 from side wall 14 to side wall 15. On the rear side of housing 11 there is provided an elongated bracket member 21 having a hole 22 for supporting an operating cylinder for the wrench, as will be subsequently described. The left end portion of housing 11, as seen in FIG. 1, is rounded as indicated at 23 and circular openings 24 and 25 are provided in walls 14 and 15 for supporting a ratchet mechanism which will be subsequently described.

The tubes 19 and 20 provide for connection of the wrench to the reaction arm 26 having a supporting ring 27. Reaction arm 26 is supported on a bolt 28 extending through tube 20 and held in place by a nut 29. Reaction arm 26 can also be positioned on a bolt extending through tube 19 if the spacing of the nuts or bolts to be worked on by the wrench so requires.

Figure 2:
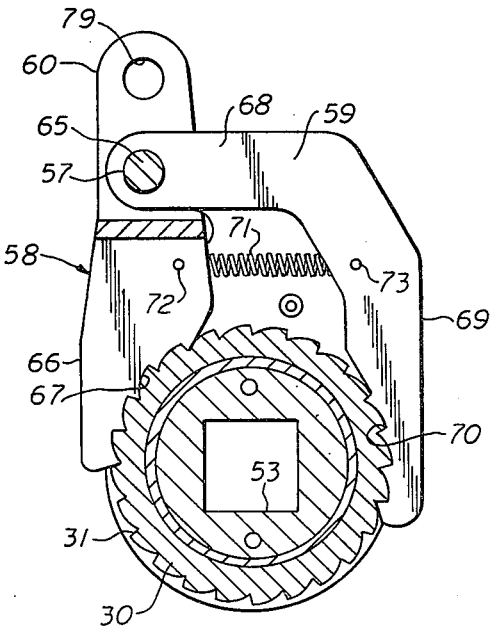
FIG. 2 is a detail view of the ratchet mechanism with the cover plate removed, and partly in section.
Figure 3:
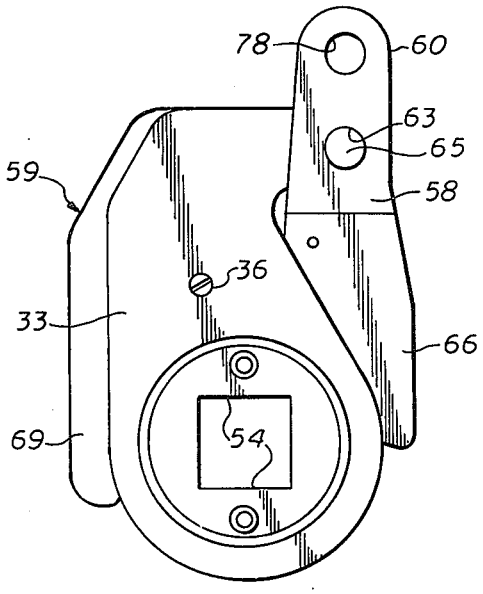
FIG. 3 is a view of the ratchet wheel assembly from the reverse side.
Figure 4:
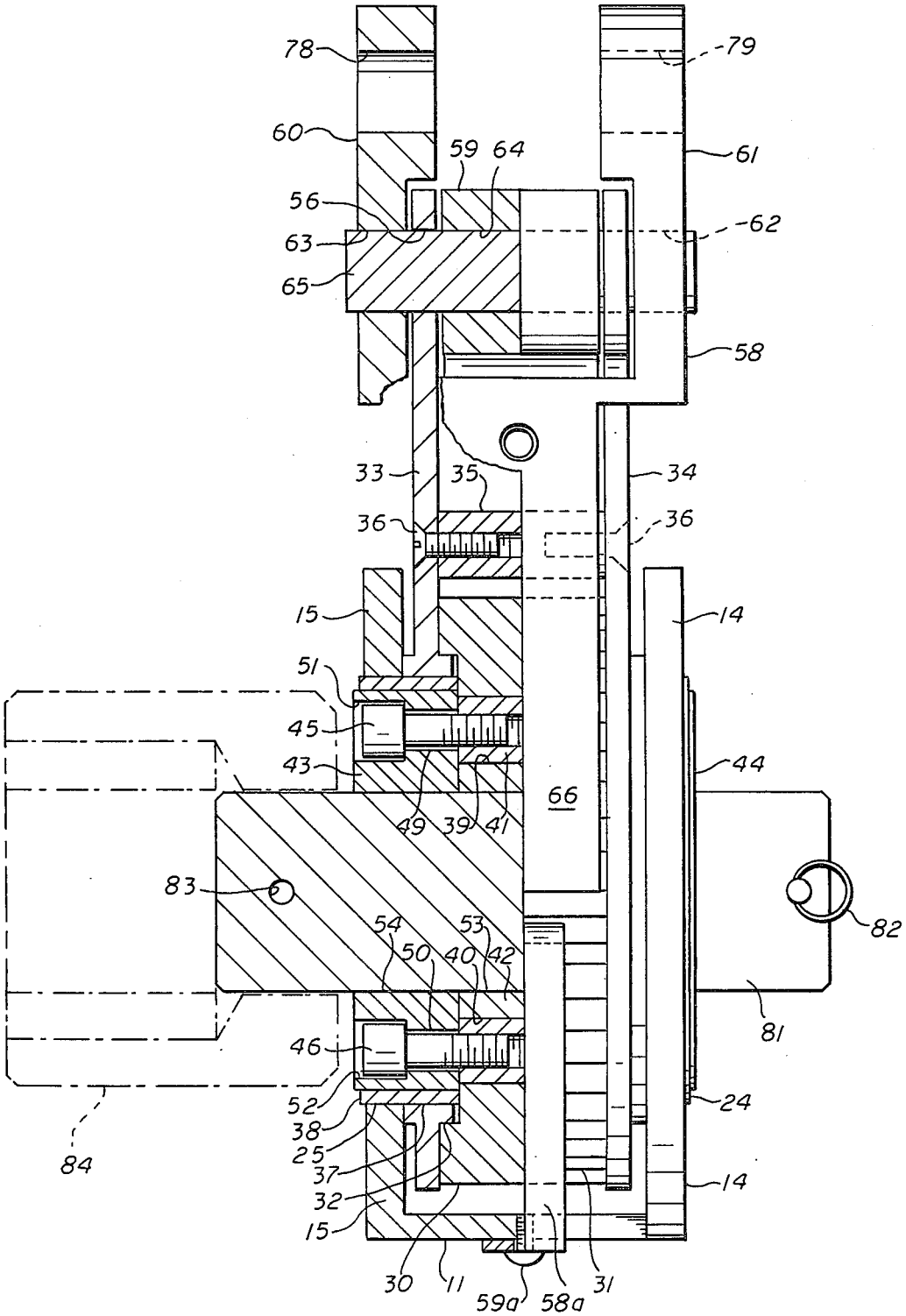
FIG. 4 is a half sectional view of the ratchet mechanism taken on the line 4—4 of FIG. 1, with the right ride shown in full elevation.

The ratchet mechanism consists of ratchet wheel 30 having ratchet teeth 31 extending around the circumference thereof, as seen in FIGS. 2 and 4. Ratchet wheel 30 has a counterbore 32 on one side and a similar counterbore (not shown) on the other side. Ratchet wheel 30 is supported between plate members 33 and 34 which are secured to opposite ends of a spacer member 35 by a pair of flat head machine screws 36 (the one on the opposite side not being shown).

Plate members 33 and 34 have flanged circular openings 37 therein. The flanges of circular openings 37 fit the counterbores 32 on opposite sides of ratchet wheel 30 and are rotatable therein. The flanges of openings 37 are also rotatable on bearing sleeves 38 which are positioned in openings 24 and 25 on both sides of housing 11. Ratchet wheel 30 has a pair of passages 39 and 40 extending laterally therethrough in which there are positioned sleeves 41 and 42.

A pair of thick cylindrical plate members 43 and 44 are provided on opposite sides of ratchet wheel 30 and are secured together by Allen machine screws 45 and 46 on one side and 47 and 48 on the other side. The Allen screws extend through passages 49 and 50 in plate member 43 and corresponding passages in plate member 44. Counterbores 51 and 52 are provided to permit the recessing of the enlarged head portion of the Allen machine screws. Ratchet wheel 30 has a square central opening 53. Plate members 43 and 44 have square central openings 54 and 55 which are aligned with the ratchet opening 53 when assembled together by means of machine screws 45 and 46. When assembled together, ratchet wheel 30 and plates 43 and 44 form a unit which rotates in bearing sleeve 38. Optionally, plates 43 and 44 may be pinned, or otherwise removably secured, to sleeves 38 for movement together.

The upper ends of supporting plate members 33 and 34 have holes 56 and 57. A pair of ratchet pawls 58 and 59 are supported on plates 33 and 34. Pawl 58 has a bifurcated yoke at its upper end with spaced legs 60 and 61. Leg 61 has a hole 62 which aligns with hole 57 in plate 34. Leg 60 has a hole 63 which aligns with hole 56 in plate 33. Pawl 59 has a hole 64 through its upper end which aligns with holes 56 and 57 in plates 33 and 34. A bearing pin 65 extends through the aligned holes in pawls 58 and 59 and plates 33 and 34 to support the pawls for pivotal movement on the supporting plates 33 and 34.

Pawl 58 has a downwardly extending portion 66 below the upper yoke which terminates in an arcuate portion having teeth 67 which engage the teeth 31 of ratchet wheel 30. Teeth 67 have a shape engaging the teeth 31 for positive movement in a counterclockwise direction, as viewed in FIGS. 1 and 2. Pawl 59 has the shape of a bent lever with a horizontally extending portion 68 and vertically extending portion 69, as seen in FIGS. 1 and 2, with an arcuate section having teeth 70 which engage teeth 31 of ratchet wheel 30. Teeth 70 engage teeth 31 to provide a positive driving action on counterclockwise rotation, as seen FIGS. 1 and 2, and a ratcheting movement upon clockwise rotation. Pawls 58 and 59 are urged toward engagement with ratchet wheel 30 by means of extension spring 71 which is secured at its opposite ends by roll pins 72 and 73. A spring pawl 58*a* is secured on housing 11 by machine screw 59*a* adjacent to edge 13 of the open end of the housing. Pawl 58*a* engages teeth 31 on ratchet wheel 30 to prevent the wheel from rotating backward when the pawls 58 and 59, and plates 33 and 34 are moved backward during ratcheting movement.

A fluid operated piston 74 is supported on the housing 11 by means of a connecting pin 75 extending through bracket 21 and apertured supporting portion 76 on the cylinder. Cylinder 74 is preferably operated by hydraulic fluid, although other fluids such as compressed air or the like might be used for operation. Operating cylinder 74 has a piston 77 which extends between arms 60 and 61 of the yoke portion of pawl 58. The arms of the yoke are provided with holes 78 and 79 through which a pin 80 extends, passing through a hole 81 in the end of piston 77.

The movement of piston 77 by cylinder 74 is operable to provide a positive movement in either a clockwise or counterclockwise direction to pawls 58 and 59 and plates 33 and 34. Extension of piston 77 is operable to cause pawls 58 and 59 to rotate in a counterclockwise direction and to drive the ratchet wheel 30 in a counterclockwise direction. Retraction of piston 77 causes ratchet pawls 58 and 59 to rotate in a clockwise direction with a ratcheting rotation relative to the piece 31 to ratchet wheel 30. The square openings in ratchet wheel 30 and plates 43 and 44 receive a square bar 81 having a ring 82 for removal and a spring loaded pin 83 at the opposite end for securing a socket wrench 84 thereon.

ASSEMBLY AND OPERATION OF THE INVENTION

The apparatus described above is for use in tightening or loosening nuts or bolts in various types of commercial equipment. Typically, the apparatus would be used for tightening or loosening bolts in a circular pattern on the flanges of a heat exchanger or a pressure vessel, or on the flanges of a blowout preventer. The apparatus is used in tightening or loosening nuts or bolts which may be arranged in any selected pattern, including circular patterns, straight patterns, patterns of other selected shapes or even irregular patterns.

The power operated ratchet wrench 10 has reaction arm 26 positioned with ring 27 on one of the nuts or bolt heads (not shown) and a socket wrench positioned on the end of square bar 81 and over a nut or bolt head to be tightened or loosened upon rotation of the bar by operating cylinder 74 working through the improved ratchet mechanisms. The use of the removable square bar 81 for the socket wrench allows the powered ratchet wrench assembly to be used reversibly by turning the assembly over, relative to the position shown in FIG. 1, to permit the ratchet to operate in the opposite direction.

In assembling the powered ratchet wrench 10, the housing 11 would be provided initially with no components installed therein. Ratchet wheel 31 has sleeves 41 and 42 positioned in openings 39 and 40. Next, supporting plates 33 and 34 are positioned on opposite sides of ratchet wheel 30 with the flanges at opening 37 fitting into the counterbore 32 on each side of the wheel. Plates 33 and 34 have spacer 35 positioned therebetween and flat head machine screws 36 are tightened into the spacer which holds the plates secured to ratchet wheel 30 and rotatable relative thereto.

In this position, this unit or subassembly is of a size which clears the side walls 14 and 15 of the housing 11 and can be inserted into the open end portion of the housing. This subassembly is inserted into the open end portion of the housing and sleeves 38 are inserted on opposite sides through housing openings 24 and 25. Sleeves 38 abut the counterbore portion on each side of ratchet wheel 30 and extend slightly outward beyond the surface of walls 14 and 15. Sleeves 38 function as bearings for the wheel assembly which rotates on the circular walls of openings 24 and 25 in housing walls 14 and 15.

Clamping plates 43 and 44 are then positioned on opposite sides of ratchet wheel 30 with square openings 54 and 55 aligned with the square opening 53 in the ratchet wheel. Allen machine screws 45 and 46 are inserted through plates 43 and 44 and tightened to complete the ratchet wheel assembly. When the ratchet wheel assembly is completed in this manner, bearing sleeves 38 are secured tightly between clamping plates 34 and the flanged openings in supporting plates 33 and 34. The laterally extending flanges of openings 37 fit against ratchet wheel 30 on one side and provide a guiding bearing surface for movement of the ratchet wheel assembly along the inner wall surface of housing wall portions 14 and 15.

Ratchet pawls 58 and 59 are positioned as shown on opposite sides of ratchet wheel 30 and supported by pin 65 extending through pawls 58 and 59 and the holes in plate members 33 and 34. Spring 71 is positioned to secure pawls 58 and 59 together resiliently. The distance and angle from the center of ratchet wheel 30 to the pivot point of the driving pawls 58 and 59 is carefully selected so that on angular movement of the pawls for ratcheting action the teeth 67 and 70 of the pawls will pass over the ratchet wheel teeth 31 and seat at the same time in the teeth at the next position. The operating cylinder 74 is positioned on the wrench assembly by a pinned connection to bracket 21. Piston 77 is provided with a connection by means of pin 80 to holes 78 and 79 in the yoke portion of pawl 58. Reaction arm 26 is installed on housing 11 by means of bolt 28 and nut 29.

With the apparatus assembled as just described, it is ready for use. The supporting ring 27 of reaction arm 26 is positioned over one of the nuts or bolt heads nearby to the nut or bolt head to be turned by the wrench. A socket wrench is placed on square bar 81 and over the head of the nut or bolt head to be turned.

In this position, there is a rigid three-point connection for the wrench assembly established by ring 27, bolt 28 and the nut or bolt head being turned by the socket wrench. Operation of cylinder 74 to extend piston 77 will move plates 33 and 34 and will cause pawls 58 and 59 to apply torque to ratchet wheel 30 to turn square bar 81 and the socket wrench supported thereon. Retraction of piston 77 rotates pawls 58 and 59 in the reverse direction permitting the pawls to move in a ratcheting movement relative to the teeth 31 of ratchet wheel 30 and relative to supporting plates 33 and 34. After full retraction of the piston 77, further operation of cylinder 74 to extend piston 77 will again cause counterclockwise rotation of pawls 58 and 59 (and move plates 33 and 34 therewith) to turn ratchet wheel 30 and the wrench which is operated thereby.

While this invention has been fully and completely described with emphasis upon a single preferred embodiment, it should be understood that within the scope of the appended claims the invention may be practiced otherwise than as specifically shown and described herein.

I claim:

1. A powered ratchet wrench for turning threaded members comprising an elongated, box-shaped supporting housing with an open end having spaced parallel side plates with aligned circular openings therein, a pair of supporting plates positioned in said housing opening adjacent to said side plates, secured together in spaced parallel relation and having holes of the same size as and aligned with said circular openings, a ratchet wheel having a non-circular hole therethrough adapted to receive a drive shaft for a wrench to be operated thereby and supported for rotation in said circular housing openings, removable bearing members positioned in said circular openings operatively supporting said ratchet wheel and said supporting plates and providing bearing surfaces for movement of said ratchet wheel in said circular openings and of said supporting plates relative to said ratchet wheel, a first pawl having a bifurcated yoke at the top with a curved pawl surface with teeth in the lower end thereof fitting the teeth of said ratchet wheel, said supporting plates being pivotally connected to said pawl inside said yoke with a portion of said yoke extending beyond said pivoted connection, a second pawl in the shape of a substantially 90° bent arm fitting around said ratchet wheel and having teeth in the lower end thereof positioned to engage the ratchet teeth in driving relation thereto and pivotally connected inside said yoke to said frst pawl and said supporting plates, a spring operatively connected to said pawls urging the same into engagement with said ratchet wheel teeth, said pawl teeth being engagable with the teeth of said ratchet wheel on opposite sides thereof and fitting said ratchet wheel teeth for driving said wheel upon movement in one direction and for having a ratcheting function relative to said wheel upon movement in the opposite direction, a retaining pawl comprising a spring member supported on said housing and engageable with said ratchet wheel and permitting rotation thereof in said one direction and restraining the same from rotation in said opposite direction, a double acting, fluid pressure operated cylinder and operating piston extending therefrom, secured on said supporting housing, said operating piston being connected to said yoke extension for moving said pawls and said supporting plates together to rotate said ratchet wheel, and a reaction arm secured on said housing having a supporting ring for positioning over a fixed projection near the threaded member to be turned by the wrench.

2. A powered ratchet wrench according to claim 2 in which said ratchet wheel is of a three-part construction comprising a central disc with ratchet teeth and a pair of supporting discs removably secured on opposite sides thereof, said ratchet wheel central disc and supporting discs each have non-circular openings therein of equal size and shape which are aligned when assembled to provide a continuous non-circular opening of uniform size therethrough operable to receive a drive shaft of the same cross-section, said removable bearing members being positioned in and fitting said circular openings in said housing and said supporting plates, and said supporting discs fitting said bearing members in bearing relation thereto when secured to said ratchet wheel central disc.

3. A powered ratchet wrench according to claim 2 in which said ratchet wheel central disc has a counterbore on opposite sides thereof of a size receiving said removable bearings and said supporting discs, said supporting plate openings have inwardly and outwardly extending flanges providing a smooth cylindrical surface receiving said bearing members and fitting said central disc counterbores in the inwardly extending portion and abutting the inside of said housing walls on the outwardly extending portion, said ratchet wheel central disc and supporting discs each have square openings therein of equal size which are aligned when assembled to provide a continuous square opening of uniform cross section therethrough operable to receive a square drive shaft of the same size, and the distance and angle from the center of said ratchet wheel to said pivotal connection of said driving pawls is predetermined so that on angular movement of said pawls for ratcheting action the teeth of said pawls pass over said ratchet wheel teeth and seat at the same time in said ratchet wheel teeth at the next position.

* * * * *